US007082623B2

(12) United States Patent
Johnson et al.

(10) Patent No.: US 7,082,623 B2
(45) Date of Patent: Aug. 1, 2006

(54) IMPACT ABSORBING PROTECTIVE GEAR

(75) Inventors: Robert D Johnson, Wyoming, MI (US); Charles E Sereff, Broomfield, CO (US)

(73) Assignee: Vital Spot, Inc., Wyoming, MI (US)

( * ) Notice: Subject to any disclaimer, the term of this patent is extended or adjusted under 35 U.S.C. 154(b) by 0 days.

(21) Appl. No.: 10/952,518

(22) Filed: Sep. 28, 2004

(65) Prior Publication Data

US 2006/0064801 A1 Mar. 30, 2006

(51) Int. Cl.
*A42B 3/00* (2006.01)

(52) U.S. Cl. ..... 2/413

(58) Field of Classification Search ..... 2/410–414, 2/421, 423, 202, 208, 171, DIG. 3
See application file for complete search history.

(56) References Cited

U.S. PATENT DOCUMENTS

| | | | | | |
|---|---|---|---|---|---|
| 4,513,449 | A * | 4/1985 | Donzis | 2/462 |
| RE34,661 | E | 7/1994 | Grim | 602/27 |
| 5,815,846 | A * | 10/1998 | Calonge | 2/413 |
| 5,898,938 | A | 5/1999 | Baylor et al. | 2/20 |
| 5,950,244 | A * | 9/1999 | Fournier et al. | 2/414 |
| 6,058,505 | A | 5/2000 | Bettencourt | 2/425 |
| 6,065,159 | A | 5/2000 | Hirsh | 2/425 |
| 6,279,160 | B1 | 8/2001 | Chen | 2/24 |
| 6,397,399 | B1 | 6/2002 | Lampe et al. | 2/425 |
| 6,438,761 | B1 | 8/2002 | McGarrity | 2/410 |
| 6,493,881 | B1 | 12/2002 | Picotte | 2/413 |
| 6,625,820 | B1 | 9/2003 | Lampe | 2/425 |
| 6,691,324 | B1 | 2/2004 | Nakamura | 2/425 |
| 2003/0187378 | A1 | 10/2003 | Gaylord et al. | 602/62 |

* cited by examiner

*Primary Examiner*—Tejash Patel
(74) *Attorney, Agent, or Firm*—Van Dyke, Gardner, Linn & Burkhart, LLP

(57) ABSTRACT

An impact absorbing protective gear for protecting an area of the wearer's body includes a pad, which is configured to generally conform to the area of the wearer's body, and a fluid containing body. The pad includes an inner surface and an outer surface, with the inner surface for facing the area of the wearer's body. The pad is formed from a resilient energy-absorbing material wherein the outer surface flexes inwardly when impacted by a force applied to the outer surface. The inner surface includes at least one recessed portion. The fluid containing body is located in the recessed portion and has a volume less than the volume of the recessed portion wherein the fluid containing body can deform in the recessed portion upon impact from the force to thereby increase the amount of energy absorbed by the protective gear.

28 Claims, 11 Drawing Sheets

IMPACT ABSORBING PROTECTIVE GEAR

BACKGROUND OF THE INVENTION

The present invention generally relates to impact absorbing gear for protecting an area of a wearer's body and, more particularly, to impact absorbing gear for protecting a wearer's body that is subject to a force, such as a force applied during training, such as self-defense training, including marshal arts training, law enforcement training, or boxing training.

SUMMARY OF THE INVENTION

According to the present invention, an impact absorbing protective gear is provided that is configured to reduce the impact to the wearer's body over the known prior art devices.

In one form of the invention, an impact absorbing protective gear for protecting an area of the wearer's body includes a pad and a fluid containing body. The pad is configured to generally conform to the area of the wearer's body and is formed from a resilient energy absorbing material such that the outer surface of the pad flexes inwardly when it is impacted by a force applied to the outer surface of the pad. The inner surface of the pad includes at least one recessed portion for receiving the fluid containing body. The fluid containing body, which is positioned in the recessed portion, has a volume less than the volume of the recessed portion so that the fluid containing body can deform upon impact from the force to thereby increase the amount of energy absorbed by the protective gear.

In one aspect, the fluid containing body comprises a gel containing body, such as a gel pack. In another aspect, the pad comprises a foam material. Additionally, the pad may include a soft vinyl layer or skin over the foam material to form the outer surface and, optionally, the inner surface.

In another aspect, the fluid containing body is held in the recessed portion by at least one fastener. For example, the fastener may comprise hook and loop fasteners, such as VELCRO strips.

According to further aspects, the inner surface of the pad includes a plurality of recessed portions, with each of the recessed portions having held therein at least one fluid containing body. Optionally, one or more of the recessed portions may include a plurality of fluid containing bodies.

In the preferred embodiments, the pad is configured to follow a contour of a head of the wearer, a hand of the wearer, or a foot of the wearer.

In yet other aspects, the protective gear further includes a liner, with the fluid containing body being mounted to the liner. The liner aligns the fluid containing body with the recessed portion of the pad. For example, the liner may include a pocket, which generally aligns with the recessed portion, for holding the fluid containing body to thereby mount the fluid containing body to the liner and align the fluid containing body with the recessed portion. In addition, the liner may include one or more fasteners for securing the pad to the liner and one or more fasteners, such as a strap, for securing the liner to the area of the wearer's body.

According to another form of the invention, an impact absorbing protective gear for protecting an area of the wearer's body includes a pad, a liner, and a fluid containing body, which is mounted to the liner. The pad is formed from a resilient energy absorbing material wherein the outer surface flexes inwardly when it is impacted by a force applied to the outer surface. In addition, the inner surface has at least one recessed portion. The liner and pad are configured to align the fluid containing body with the recessed portion, which deforms upon impact from the force to thereby increase the amount of energy absorbed by the protective gear.

In one aspect, the fluid containing body has a volume less than the volume of the recessed portion wherein the fluid containing body can deform in the recessed portion to thereby increase the amount of energy absorbed by the protective gear.

As would be understood by those skilled in the art, the present invention provides an impact absorbing protective gear that is adapted to increase the amount of impact that the gear can absorb and reduce the amount of impact transferred to the user's body. These and other objects, features, and advantages will be more apparent from the study of the drawings and description which follow.

DETAILED DESCRIPTION OF THE DRAWINGS

DETAILED DESCRIPTION OF THE PREFERRED EMBODIMENTS

Figure 1:
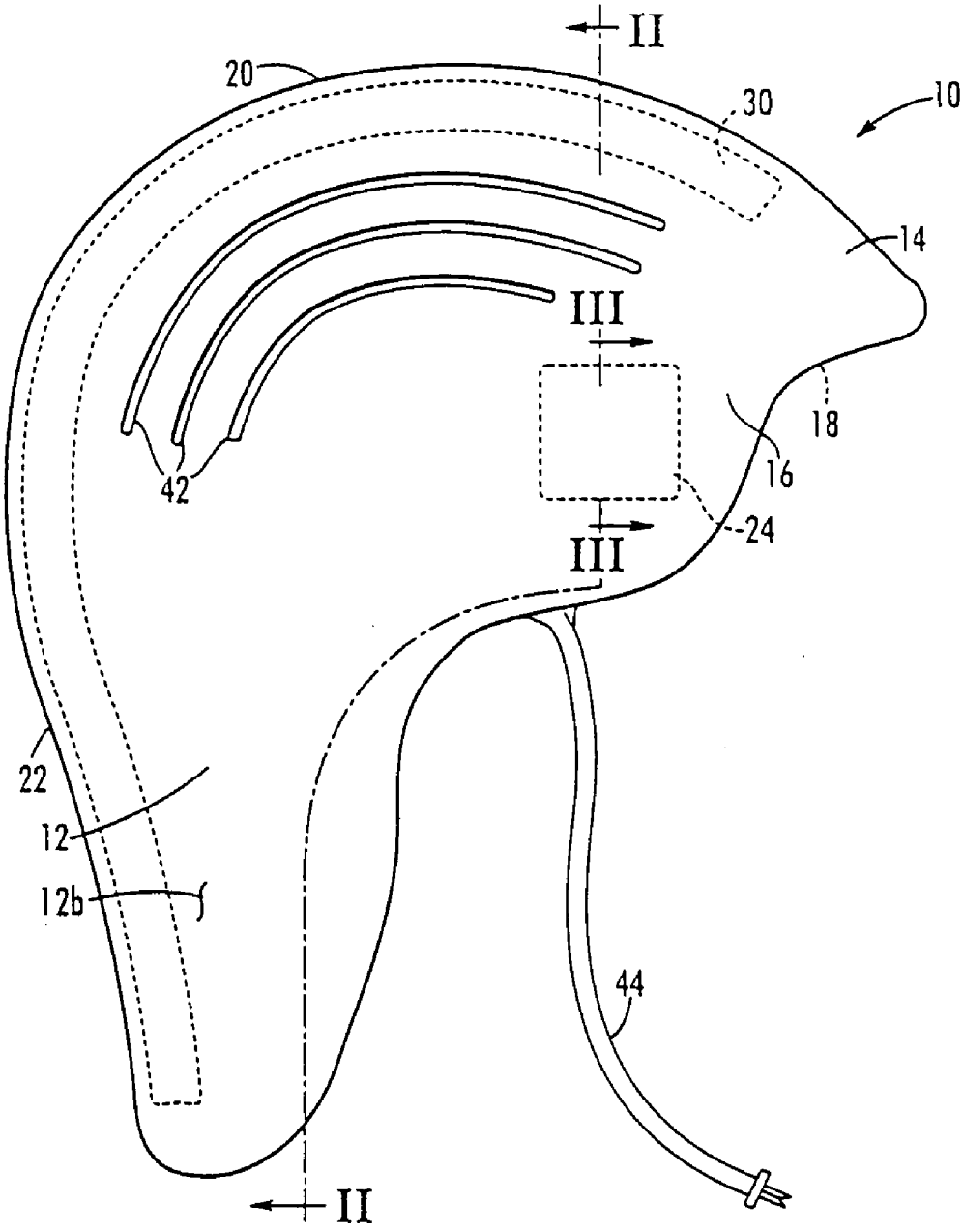
FIG. 1 is a side elevation view of a impact absorbing protective gear of the present invention in the form of a head gear.
Figure 2:
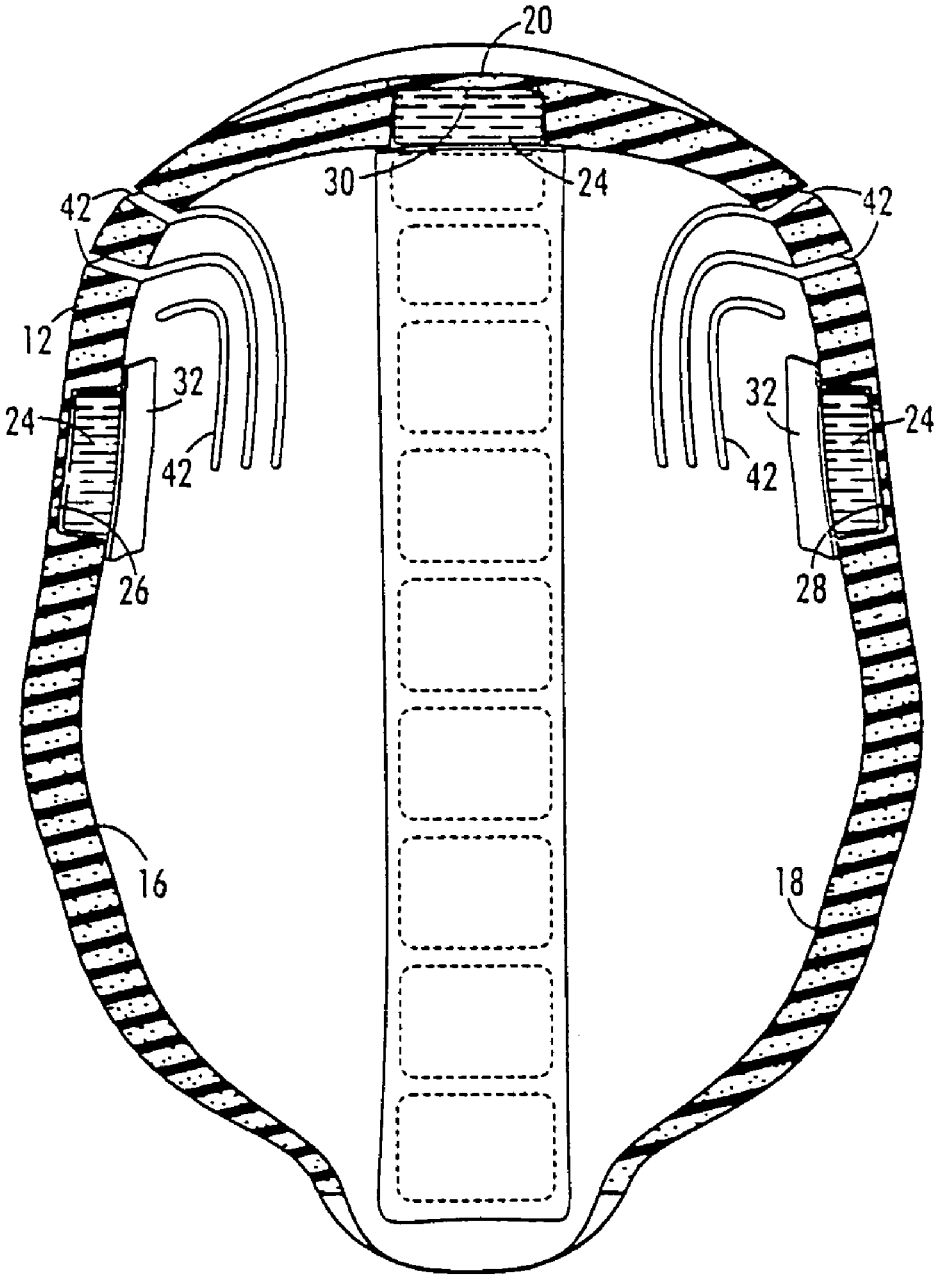
FIG. 2 is a cross-section view taken along a line II—II of FIG. 1.

Referring to FIG. 1, the numeral 10 generally designates a first embodiment of the impact absorbing protective gear of the present invention. Impact absorbing protective gear 10 comprises head gear that is suitable for protecting the head of a person. Gear 10 provides high impact protection to discrete areas of the head including, for example, the temporal lobes, the occipital lobes, and the cervical vertebrae. Impact absorbing protective gear 10 is particularly suitable for use in contact training, such as in self-defense, martial arts, military training, law enforcement training, boxing training, and the like. The areas of increased protection generally correspond to those areas that are considered as strike targets and, particularly, those areas that are more vulnerable to injury. As will be more fully described below, impact absorbing protective gear 10 includes increased areas of protection by incorporating fluid containing bodies that deform upon the application of a force to the outside of the gear so that the impact of the force to the body of the wearer is significantly reduced over conventional protective gear.

As best understood from FIGS. 1–5, gear 10 is formed from a pad 12, which is adapted to generally follow the contours of a head. The pad is formed from a resilient impact absorbing material, such as foam, which is preferably covered by a thin layer or skin of a flexible material, such as a flexible vinyl material. In the illustrated embodiment, when protective gear 10 is placed on the head of the wearer, pad 12 includes a front region 14 that extends over the forehead, a left region 16 that extends over the left temporal lobe, a right region 18 that extends over the right temporal lobe, a top region 20 that extends over the cranium and occipital, and a back region 22 that extends down over the neck and cervical vertebrae of the wearer. The left and right side regions 16 and 18 generally terminate at or near the wearer's ears. Optionally, side regions 16 and 18 may extend over the ears.

To reduce the impact to the temporal lobes and the occipital lobe and cervical vertebrae, pad 12 incorporates one or more fluid containing bodies 24, which are aligned with the temporal lobes and the occipital lobe and cervical vertebrae. In the illustrated embodiment, fluid containing bodies 24 are located in recesses or recessed portions 26 and 28 formed in left and right portions 16 and 18 and in recess or recessed portion 30, which is located in the top of the pad and extends from the front portion 14, over the top portion 20, and down to the back portion 22 of pad 12. Although illustrated as an elongate continuous recess, it should be understood that recess 30 may be formed from a plurality of recesses. Recessed portions 26 and 28 are located in left and right portions 16 and 18 so that they at least generally align with the temporal lobes of the wearer. Similarly, recess 30 is located such that it extends over the occipital lobe and cervical vertebrae of the wearer.

Figure 6:
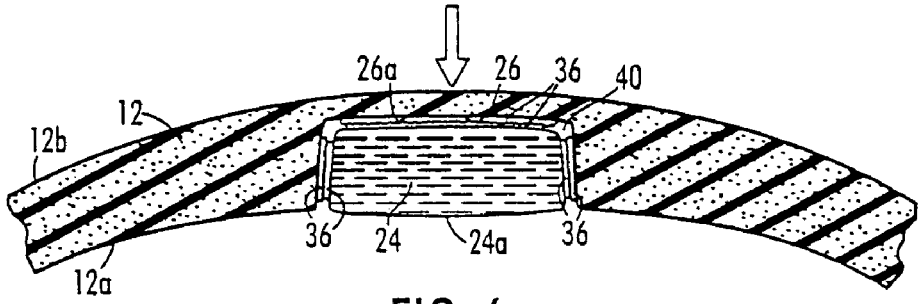
FIG. 6 is a similar view to FIG. 3 with the covers or flaps removed.
Figure 4:
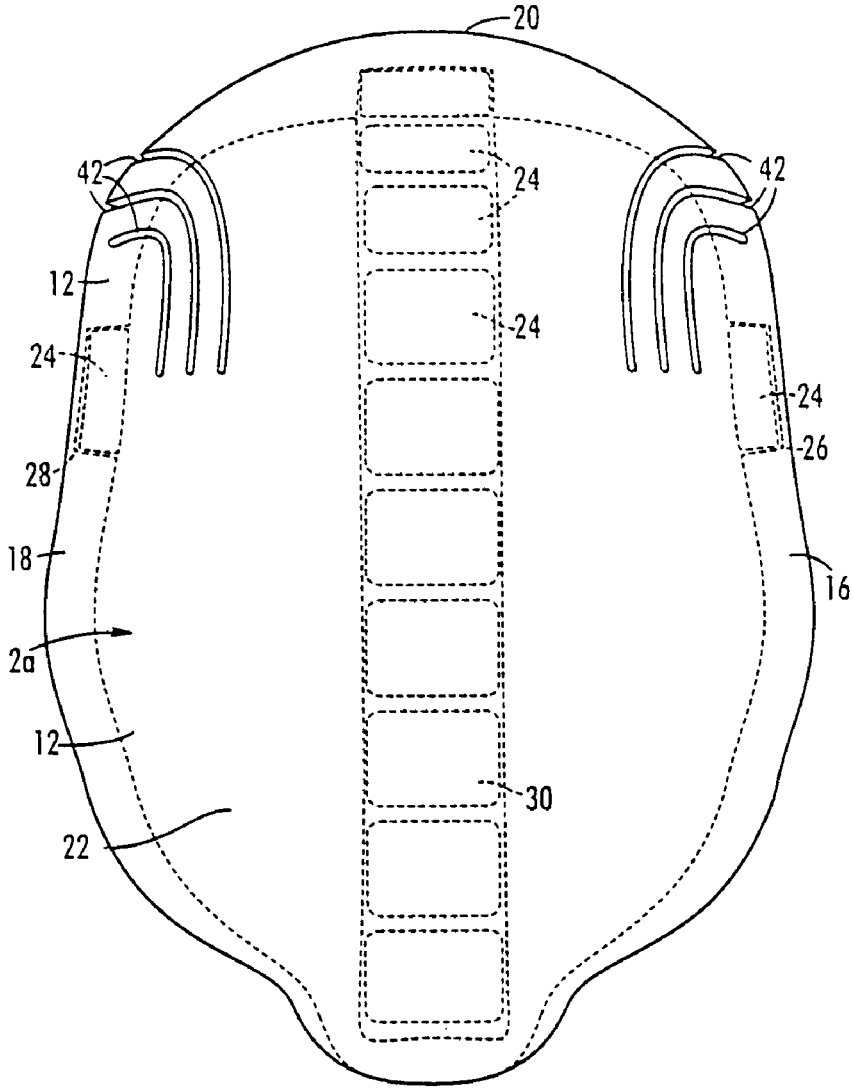
FIG. 4 is a back elevation view of the head gear of FIG. 1.
Figure 5:
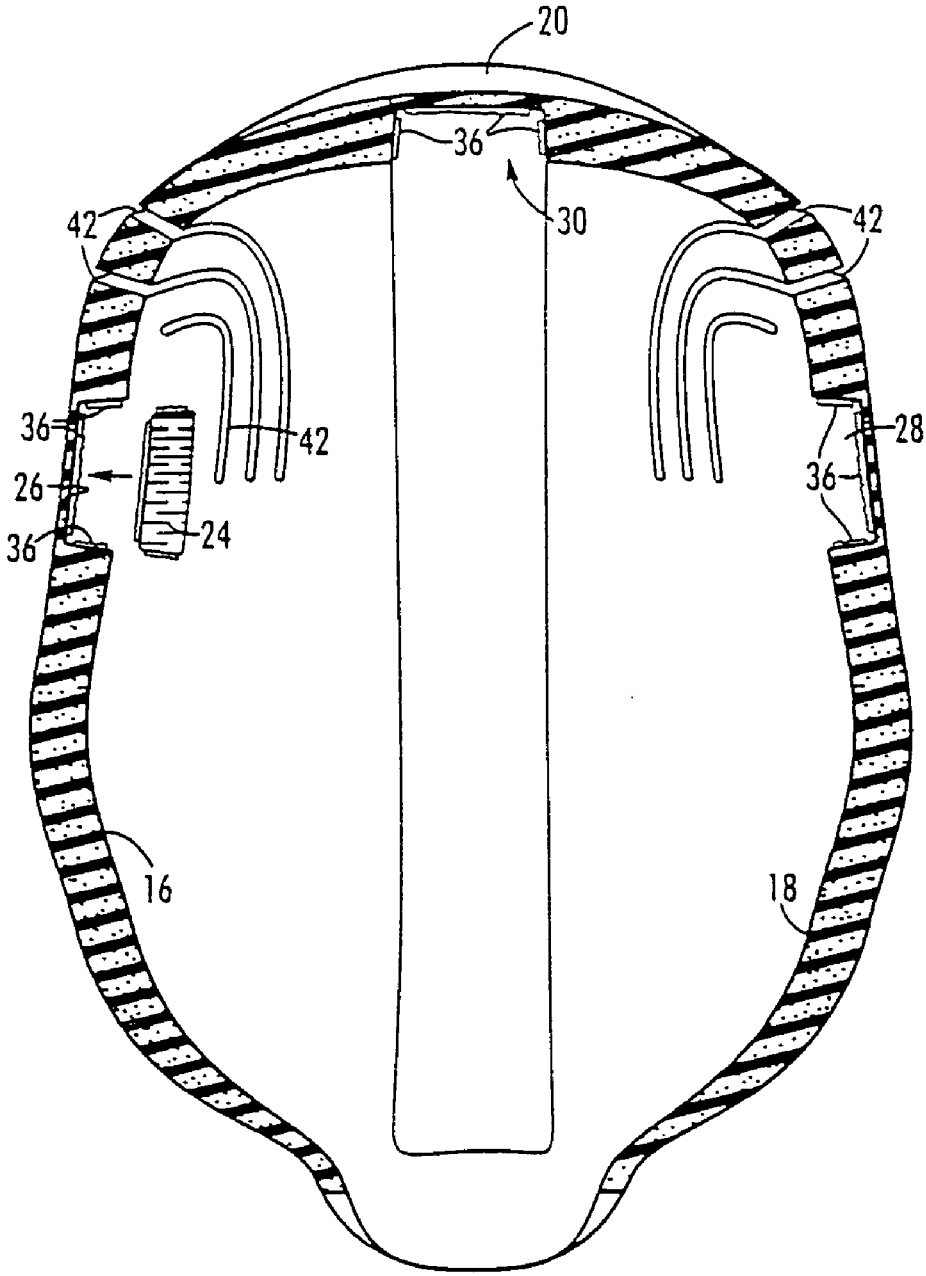
FIG. 5 is a similar view to FIG. 2 with the cover or flaps removed.

Fluid containing bodies 24 preferably comprise gel containing bodies, such as the gel packs available from Dielectric of Boston, Mass. Commercially available gel packs are provided in units, such as square or rectangular units. Therefore, to fill recess 30, a plurality of gel packs may be required. In the illustrated embodiment, fluid containing bodies 24 are held in their respective recesses by covers or flaps 32, which are secured to pad 12, for example, by fasteners, such as hook and loop fasteners, by stitching, by an adhesive, or by a weld, such as sonic welding. Covers 32 are preferably formed from a flexible material, such as a fabric or a vinyl sheet and, further, may optionally include a closure mechanism to maintain the cover or flap in its closed position to thereby secure the fluid containing body in their respective recessed portions. For example, covers or flaps 32 may be formed by the thin flexible layer or skin of the pad. Alternately, or in addition, fluid containing bodies 24 may be secured in their respective recessed portions by fasteners, such as hook and loop fasteners, including VELCRO strips or the like, such as shown in FIG. 6. Furthermore, as best understood from FIG. 3, the volume of the recessed portion is preferably greater than the volume of the fluid containing body. Therefore, a gap 40 is provided between the fluid containing body 24 and the inner surface (26*a*) of the recessed portion (26). In this manner, the fluid containing body has room to deform as a result of the impact from a force applied in direction of the arrow shown in FIG. 3.

Referring to FIG. 6, recessed portions 26, 28, and 30 may be provided without covers or flaps. In which case, the fluid containing bodies are held in the respective recesses by fasteners such as hook and loop fasteners 36, such as VELCRO strips, that may be mounted in the recessed portions and mounted to one or more sides of the fluid containing body to thereby releaseably secure the fluid containing body in the recessed portion. Again, the volume of the recessed portions should still be preferably greater than the volume of the fluid containing bodies. As would be understood, therefore, when a force is applied to the outer surface 12*b* of pad 12, the outer surface 12*b* of the pad will flex inwardly, either as a result of compression or deflection of the pad. When the force is applied to the region of the pad where the fluid containing body is located, the thickness of the pad is reduced proportionately by the depth of the recessed portion. Therefore, the pad will have a tendency to deflect inwardly such that the outer surface 12*b* flexes inwardly to thereby transfer the impact of force to the fluid containing body 24, which then deforms within the recess to absorb the impact and reduce the transfer of the force to the region of the body where the fluid containing body is located. For example, in FIG. 6 the fluid containing body 24 is located over a temporal lobe. Therefore, when a force is applied over the temporal lobe, the pad will flex and the fluid containing body will deform to reduce the impact transferred to the temporal lobe.

Referring again to FIG. 4, in the illustrated embodiment, recessed portion 30 contains a plurality of fluid containing bodies; however, it can be appreciated that a single elongate fluid containing body may be positioned in the recess. Alternately, as noted, recessed portion 30 may be formed from a plurality of recessed portions, with each recessed portion having one or more fluid containing bodies therein. Furthermore, each fluid containing body may be interconnected, for example by fasteners, such as VELCRO strips.

Figure 3:
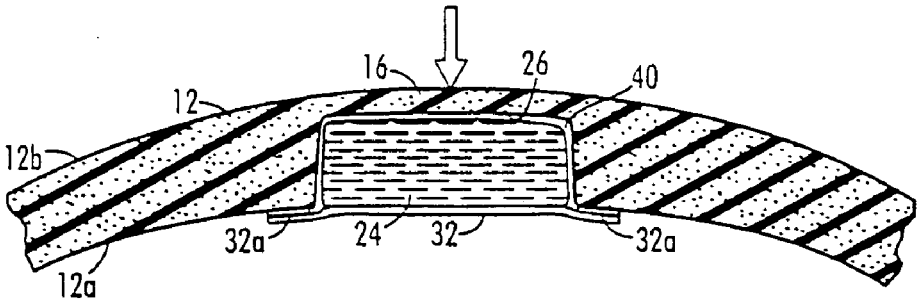
FIG. 3 is an enlarged cross-section taken along line III—III of FIG. 1.

As best seen in FIG. 3, as previously noted, one or more recessed portions, for example recessed portion 26, may include a cover or flap that encloses the recessed portion to hold the fluid containing body in the recessed portion. For example, the cover or flap may comprise a discrete piece of flexible material, such as fabric or a plastic material, such as vinyl, that is mounted to the inner surface 12*a* of pad 12. For example, the cover or flap may be mounted to pad 12 by stitching, by an adhesive, by a sonic weld, or by hook and loop fasteners, for example VELCRO strips. Alternately, the cover or flap may be formed from the cover or skin of the pad. In the illustrated embodiment, at least both ends of the cover are secured to the pad by VELCRO strips 32*a*, which permit the cover to be completely removed from the inner surface 12*a* of pad 12. Preferably, at least one end is releasably secured so that the fluid containing body may be removed from the recessed portion for replacement should the fluid containing body rupture or should a different type of fluid containing body be desired. For example, as previously noted, the fluid containing body 24 preferably comprises a gel. As would be understood by those skilled in the art, the type of gel may be varied to vary the impact absorbing characteristic of the fluid containing body. Alternately, the body may be filled with air or water, or other fluids. It should be understood that the fluid containing body 24 may be additionally secured in recess 26 by fasteners mounted to the inner surface of recess 26, such as the hook and loop fasteners illustrated in FIGS. 5 and 6.

To reduce perspiration, the pad may incorporate one or more transverse openings 42, such as transverse elongate openings, to allow air circulation through gear 10 to the user's head. Furthermore, to secure the head gear to the user's head, gear 10 preferably includes one or more straps 44.

Figure 7:
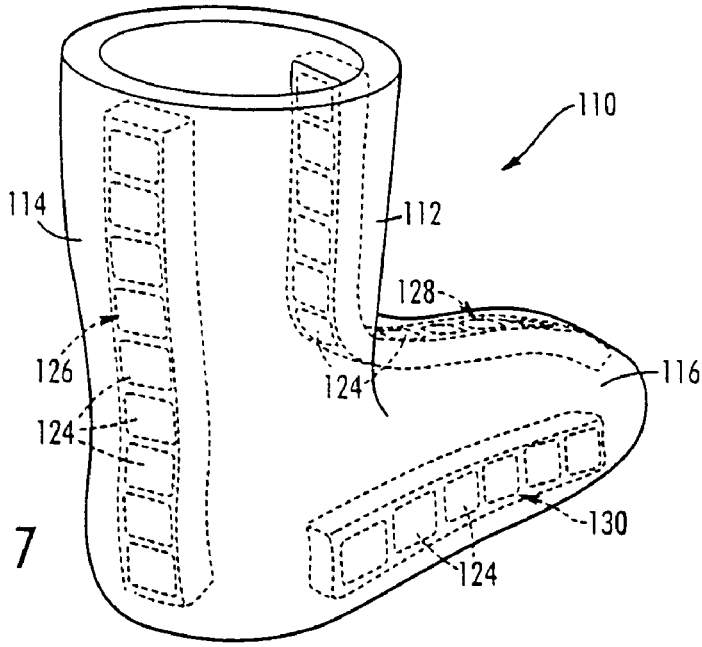
FIG. 7 is a perspective view of another embodiment of the impact absorbing protective gear of the present invention in the form of foot gear.
Figure 8:
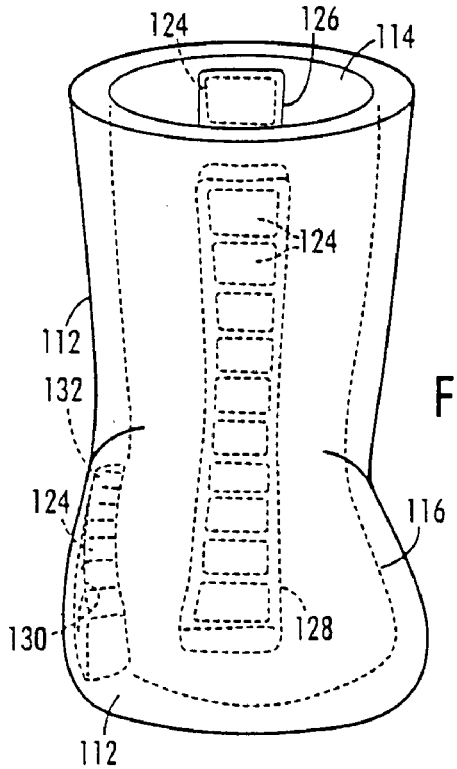
FIG. 8 is a front view of the foot gear of FIG. 7.

Referring to FIG. 7, the numeral 110 generally designates another embodiment of the impact absorbing protective gear of the present invention. In the illustrated embodiment, gear 110 is in the form of foot gear and is similarly formed from a pad 112, which is adapted to generally follow the contours of a foot. Similarly to the previous embodiment, pad 112 incorporates one or more fluid containing bodies 124, which may be incorporated in a number of different locations. For example, fluid containing bodies 124 maybe located to cover the Achilles tendon and heel and, further, to cover the front top of the foot as well as the outside region of the foot.

Pad 112 includes a first portion 114, which is generally cylindrical in shape to extend around the leg of the wearer, and a second portion 116, which extends from the first portion 114 to extend over the top of the foot of the wearer and, further, extend over both the outer and inner sides of the foot. However, pad 112 terminates generally at the sides of the foot so that the bottom of the foot is generally exposed, with the exception of the toes.

Figure 9:
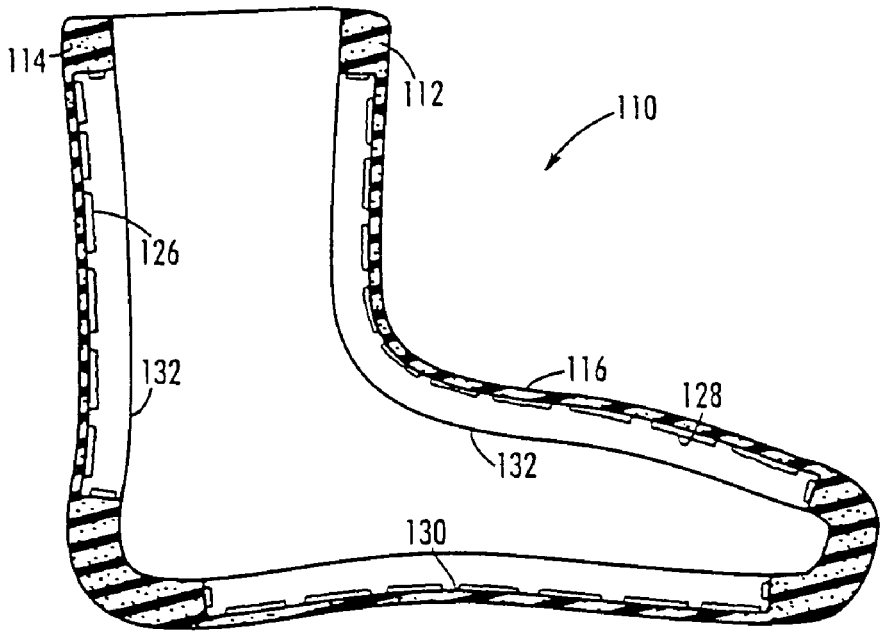
FIG. 9 is a side elevation view of the foot gear of FIG. 8.
Figure 10:
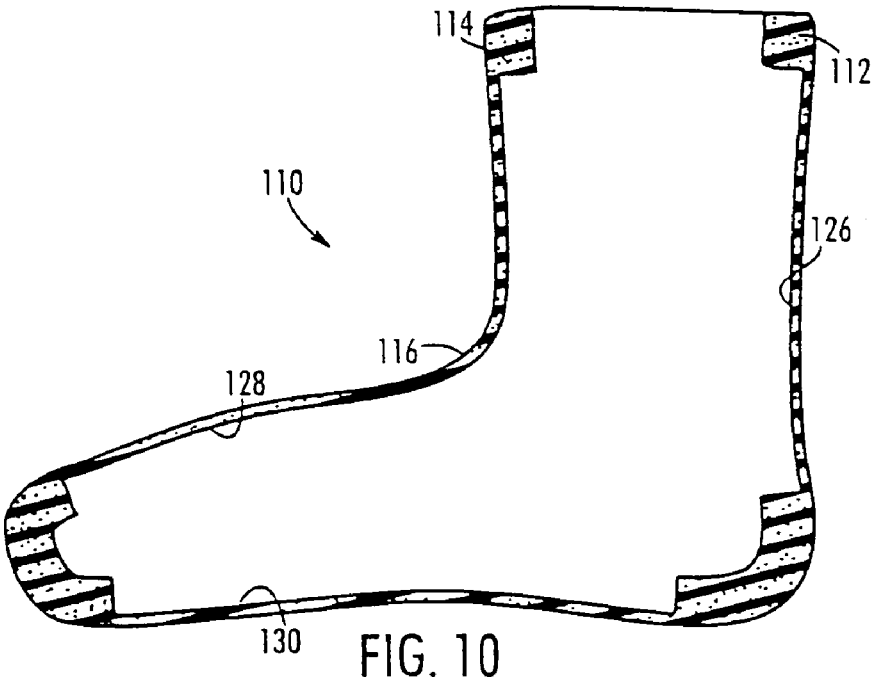
FIG. 10 is an inside elevation view of the foot gear of FIG. 7.

As best understood from FIG. 9, pad 112 similarly includes a plurality of recesses 126, 128, and 130 for locating the liquid containing bodies over the areas of the foot where additional impact protection is desired. The liquid containing bodies are located in the respective recesses and secured therein, for example, by fasteners such as hook and loop fasteners similar to the previous embodiment.

Alternately or in addition, the liquid containing bodies may be secured in the recessed portions by covers or flaps 132, which are secured to pad 112, for example, by an adhesive, a fastener, such as stitching or hook and loop fasteners, or by sonic welding. Preferably, one end of the cover 132 is releasably secured to the pad to allow the fluid containing bodies to be removed for replacement. It should be understood, in addition to the cover, fasteners may be used to provide additional securement of the liquid containing bodies within the respective recessed portions. Therefore, the fluid containing bodies may be held therein simply by the covers or flaps, or may be held by fasteners, or may be held therein by the combination of both. Similar to the previous embodiment, the respective recesses 126, 128, and 130 are sized to allow the respective liquid containing body to deform in the recess to absorb the impact of a force applied to the outer surface of the pad.

Figure 11:
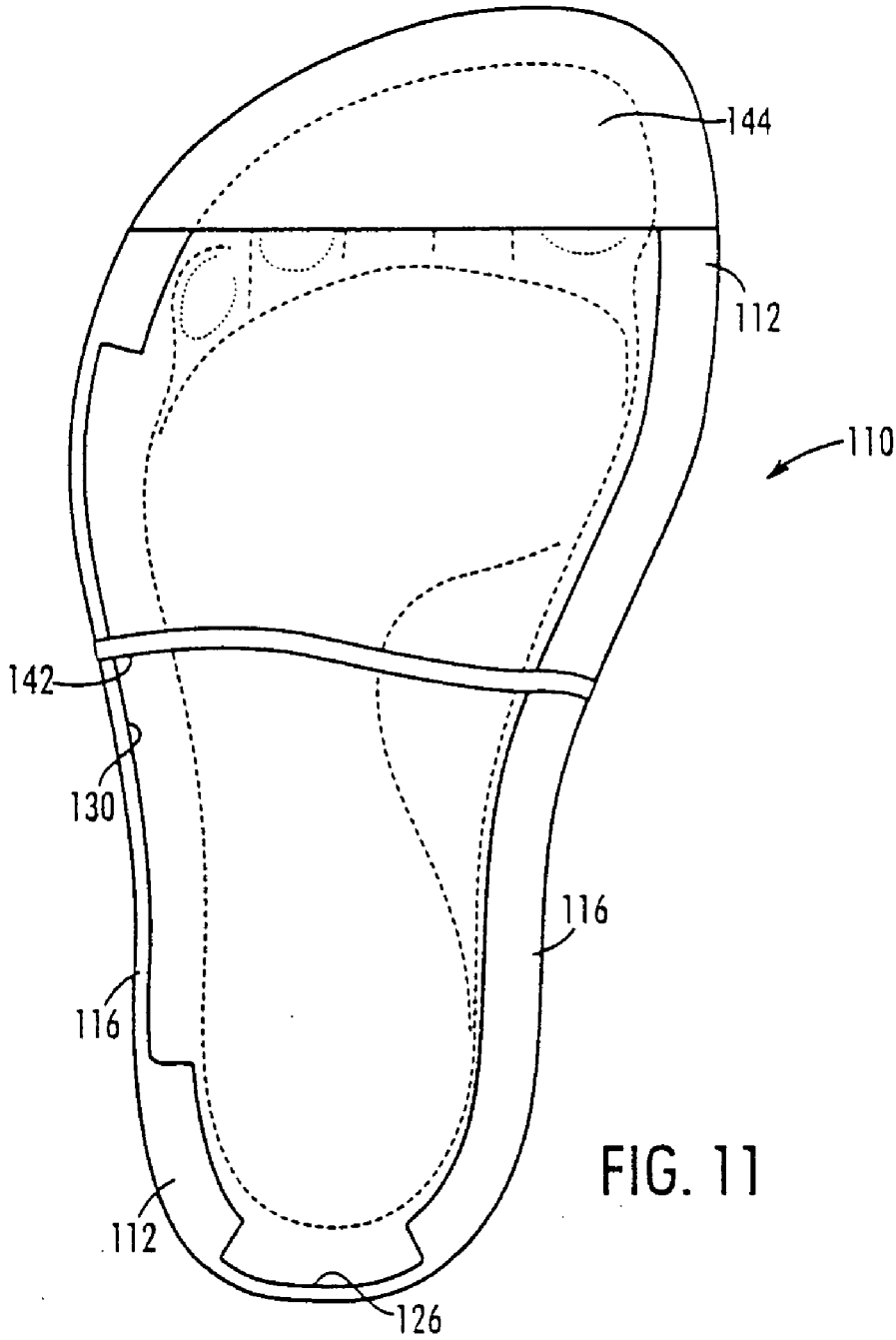
FIG. 11 is a bottom plan view of the foot gear of FIG. 7.

In best seen in FIG. 11, pad 112 optionally and preferably incorporates a strap 142 for securing the pad to the bottom of a foot. Preferably, strap 142 is located to extend under the arch of the foot. In addition, pad 112 may incorporate a flexible cover or panel 144 which extends between opposed sides of the second portion 116 of pad 112 to thereby cover the ends of the toes of the wearer's foot.

Referring to FIGS. 12–15, the numeral 210 generally designates another embodiment of the impact absorbing protective gear of the present invention. In the illustrated embodiment, gear 210 comprises hand gear that is similarly formed from a pad 212 that is adapted to follow the contour of at least a portion of the hand and includes a first portion 214 that extends around the wearer's wrist, a second portion 216 that extends over the wearer's thumb, and a third portion 218, which extends over the wearer's hand and fingers. The underside or palm side of gear 210 is preferably open, with only a portion of the fingers and thumb enclosed, as will be described below. In addition, to secure gear 210 to a wearer's hand, gear 210 includes a strap that extends over the palm or around the wrist, for example.

Gear 210 similarly incorporates a plurality of liquid containing bodies 224 which are similarly located in recessed portions 226, 228, and 230 provided on the inner surface of pad 212. Recessed portion 226 is provided at the left hand edge of the hand and extends from the wrist area to the pinky finger to provide protection to the outside handsword. Recessed area 228 is located to cover the inside of the hand to protect the inside handsword and extends from near the thumb region along the first finger. The third recess, namely recess 230, is located on the upper portion of the third portion of pad 212 and is preferably aligned with the knuckle area of the wearer's hand. Again, the liquid containing bodies preferably comprise gel containing bodies and are located in the recesses and held therein by fasteners, for example hook and loop fasteners, and/or by covers or flaps 232 that may be mounted to the inner surface of the pad 212, similar to the previous embodiments.

Figure 13:
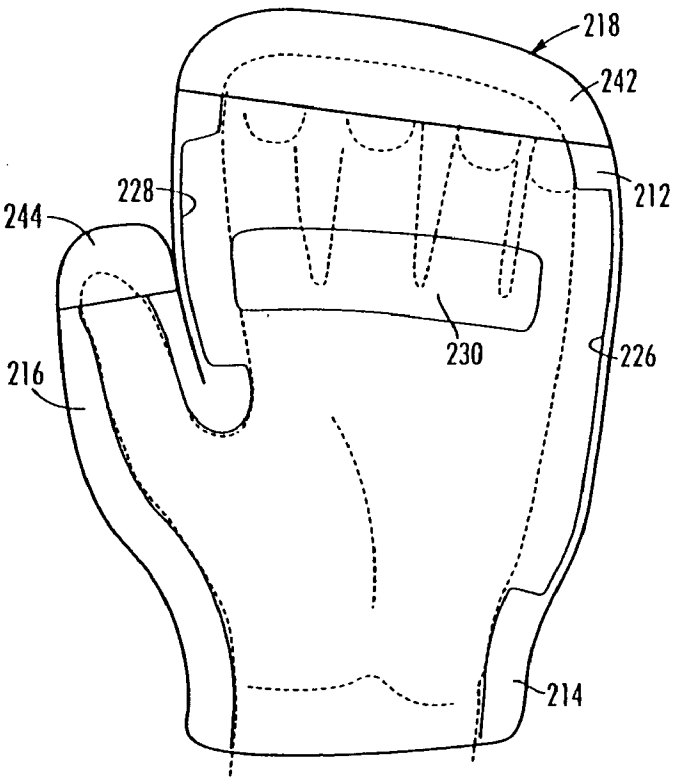
FIG. 13 is a bottom or palm view of the hand gear of FIG. 12.
Figure 12:
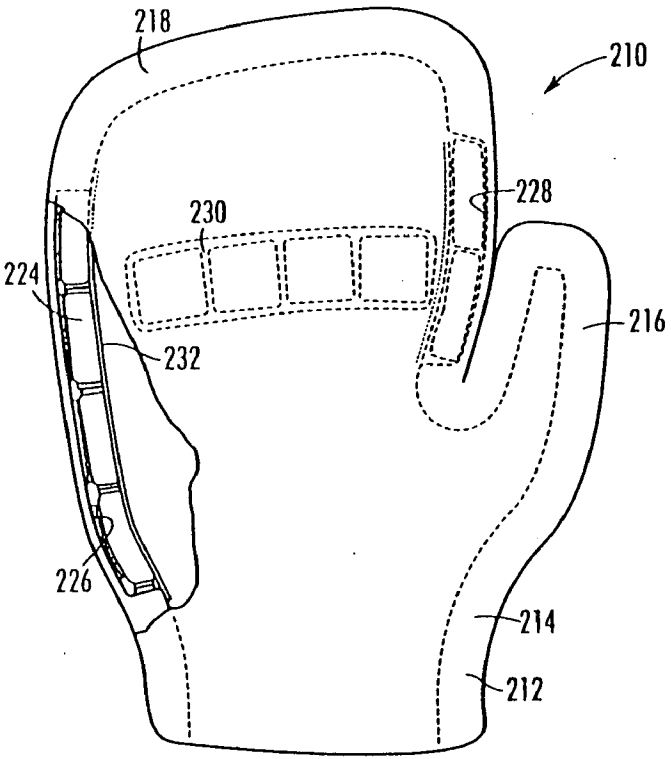
FIG. 12 is a top fragmentary plan view of another embodiment of the impact absorbing protective gear of the present invention in the form of hand gear.
Figure 14:
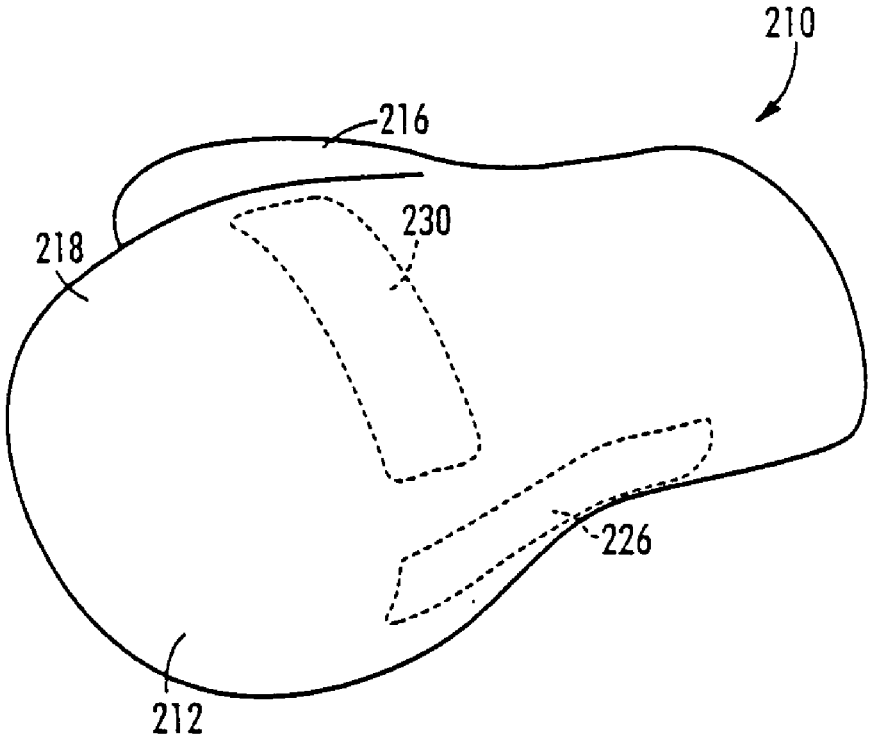
FIG. 14 is an outside elevation view of the hand gear of FIG. 12.

As best seen in FIG. 13, pad 212 also includes a panel 242, such as a skin or liner, for enclosing at least a portion of the wearer's fingers in the hand gear. Similarly, portion 216 includes a panel 244, such as a skin or liner, for enclosing at least a portion of the wearer's thumb.

Figure 15:
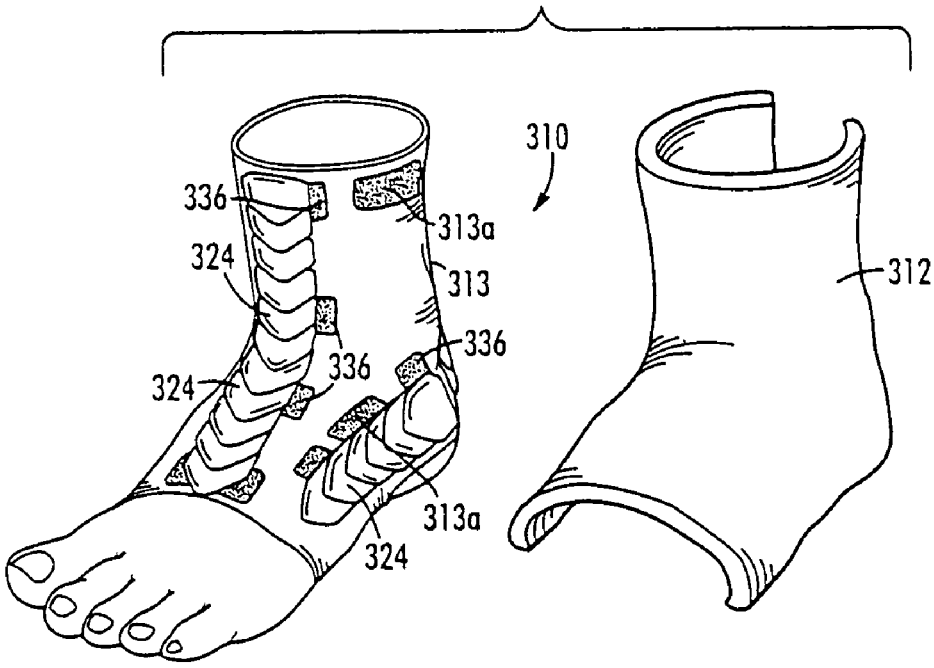
FIG. 15 is an exploded perspective view of another embodiment of the impact absorbing protective gear of the present invention.

Referring to FIG. 15, the numeral 310 generally designates another embodiment of the impact absorbing protective gear of the present invention. Though illustrated as a foot gear, it should be understood that protective gear 310 may be configured as head gear or hand gear similar to the previous embodiments, or arm gear. Protective gear 310 includes a pad 312, which is formed from a resilient impact absorbing material, such as foam, and a liner 313 to which pad 312 is secured by fasteners, for example hook and loop fasteners 313*a*, such as VELCRO. The fasteners are located to assure proper alignment between the pad and liner, as will be more fully described below.

In addition, liner 313 includes one or more liquid containing bodies 324, which are secured to liner 313 by fasteners, such as hook and loop fasteners 336. Alternately, or in addition, liner 313 may incorporate pockets into which the fluid containing bodies are inserted. Liner 313 and pad 312 are configured and arranged, for example by the placement of the fasteners and foot strap 313*b*, to align the respective liquid containing bodies with the locations of the foot and ankle where increased impact absorption is desired. Furthermore, pad 312 includes on its inner surface a plurality of recesses that correspond with the location or locations of the liquid containing bodies to provide a close fit between pad 312 and liner 313. In this manner, liner 313 supports the liquid containing bodies in the respective recessed portions. In addition, the respective recessed portions are preferably sized to allow the fluid containing bodies to deform within the recessed portion. For further details of suitable locations for the recessed portions, reference is made to the previous embodiment.

Figure 16:
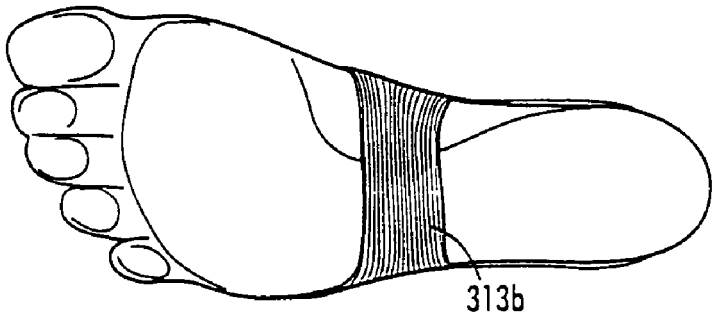
FIG. 16 is a bottom plan view of the impact absorbing gear of FIG. 15 illustrating the gear mounted to a foot.

Referring to FIG. 16, liner 313 preferably includes at least one strap 313*b*, which extends underneath the foot to secure the liner 313 and, hence, the pad 312 to the user's foot. Strap 313*b* is preferably located under the arch of the foot.

Although several embodiments of the invention have been shown and described, further changes and modification will be appreciated by those of ordinary skill in the art. Although illustrated in reference to head, arm, and foot gear, the protective gear of the present invention is also suitable for use on an arm, leg, or other parts of the body for protection. In addition, any one of the embodiments may incorporate a liner similar to the liner illustrated in the embodiment depicted in FIGS. 15 and 16. Furthermore, the number of liquid containing bodies may be increased or decreased as desired. Further, the number or locations of the liquid containing bodies may be changed. Although illustrated as single pads, any one of the pads may be formed from more than one pad section. For example, rear portion 22 of pad 12 of gear 10 may comprise a separate pad section that may be removable and, further, replaceable with a longer or shorter pad section, as will be understood by those skilled in art. Additional straps may be provided to facilitate the securement of the pad to the wearer's body. For example, a strap may be provided around the upper end of the first portion 114 of gear 110 to clamp the pad to the leg of the wearer. Furthermore, to prevent buckling of the first portion 114 of pad 112 when strapped to a leg, first portion 114 may incorporate a slotted opening such as illustrated in FIG. 15. Therefore, it will be understood that the embodiments shown in the drawings and described above are merely for illustrative purposes, and are not intended to limit the scope of the invention, which is defined by the claims that follow, as interpreted under the principles of patent law including the doctrine of equivalents.

We claim:

1. An impact absorbing protective gear for protecting an area of the wearer's body, said gear comprising:

a pad being configured to generally conform to the area of the wearer's body, said pad having an inner surface and an outer surface, said inner surface for facing the area of the wearer's body, said pad being formed from a resilient energy-absorbing material wherein said outer surface flexes inwardly when impacted by a force applied to said outer surface, said inner surface having at least one recessed portion, and said recessed portion having a volume; and a fluid containing body positioned in said recessed portion, said fluid containing body having a volume less than said volume of said recessed portion wherein said fluid containing body can deform upon impact from the force to thereby increase the amount or energy absorbed by said protective gear.

2. An impact absorbing protective gear according to claim 1, wherein said fluid containing body comprises a gel containing body.

3. An impact absorbing protective gear according to claim 1, wherein said pad comprises a foam material.

4. An impact absorbing protective gear according to claim 3, wherein said pad includes a soft vinyl layer over said foam material to form said outer surface.

5. An impact absorbing protective gear according to claim 1, wherein said fluid containing body is held in said recessed portion by a cover.

6. An impact absorbing protective gear according to claim 1, wherein said fluid containing body is held in said recessed portion by a fastener.

7. An impact absorbing protective gear according to claim 6, wherein said fastener comprises a book and loop fastener.

8. An impact absorbing protective gear according to claim 1, wherein said inner surface of said pad includes a plurality of recessed portions, each of said recessed portions having held therein at least one fluid containing body therein.

9. An impact absorbing protective gear according to claim 8, wherein at least one of said recessed portions includes a plurality of fluid containing bodies therein.

10. An impact absorbing protective gear according to claim 1, wherein said pad is configured to follow a contour of a head of the wearer.

11. An impact absorbing protective gear according to claim 1, wherein said pad is configured to follow a contour of a hand of the wearer.

12. An impact absorbing protective gear according to claim 1, wherein said pad is configured to follow a contour of a foot of the wearer.

13. An impact absorbing protective gear according to claim 1, further comprising a liner, said fluid containing body being mounted to said liner, and said liner aligning said fluid containing body with said recessed portion.

14. An impact absorbing protective gear according to claim 13, wherein said liner includes a pocket, said pocket generally aligned with said recessed portion, and said fluid containing body positioned in said pocket to thereby mount said fluid containing body to said liner and align said fluid containing body with said recessed portion.

15. An impact absorbing protective gear according to claim 14, wherein said liner includes a fastener for securing said pad to said liner and a fastener for securing said liner to the area of the wearer's body.

16. An impact absorbing protective gear for protecting an area of the wearer's body, said gear comprising:

a pad being configured to generally conform to the area of the wearer's body, said pad having an inner surface and an outer surface, said inner surface for facing the area of the wearer's body, said pad being formed from a resilient energy-absorbing material wherein said outer surface flexes inwardly when impacted by a force applied to said outer surface, said inner surface having at least one recessed portion;

a liner, said liner including at least one fastener for releasably securing said pad over said liner wherein said liner mounts said pad to the wearer's body; and a fluid containing body mounted to said liner, said liner and said pad configured to align said fluid containing body with said recessed portion, said fluid containing body deforming upon impact from the force to thereby increase the amount of energy absorbed by said protective gear.

17. An impact absorbing protective gear according to claim 16, wherein said recessed portion includes a volume, said fluid containing body having a volume less than said volume of said recessed portion wherein said fluid containing body can deform in said recessed portion to thereby increase the amount of energy absorbed by said protective gear.

18. An impact absorbing protective gear according to claim 16, said fastener for securing said pad to said liner comprises a book and loop fastener.

19. An impact absorbing protective gear according to claim 16, further comprising a fastener for securing said fluid containing body to said liner comprises a hook and loop fastener.

20. An impact absorbing protective gear according to claim 16, wherein said inner surface of said pad includes a plurality of recessed portions, each of said recessed portions having positioned therein at least one fluid containing body.

21. An impact absorbing protective gear according to claim 20, wherein said fluid containing bodies are mounted to said liner.

22. An impact absorbing protective gear according to claim 21, wherein said pad is configured to follow a contour of a head of the wearer.

23. An impact absorbing protective gear according to claim 21, wherein said pad is configured to follow a contour of a hand of the wearer.

24. An impact absorbing protective gear according to claim 23, wherein said liner comprises a sleeve.

25. An impact absorbing protective gear according to claim 20, wherein said pad is configured to follow a contour of a foot of the wearer.

26. An impact absorbing protective gear according to claim 25, wherein said liner comprises a sleeve.

27. An impact absorbing protective gear according to claim 16, wherein said liner includes a pocket, said pocket generally aligned with said recessed portion, and said fluid containing body positioned in said pocket to thereby mount said gel containing body to said liner and thereby align said gel containing body with said recessed portion.

28. An impact absorbing protective gear according to claim 27, wherein said fluid containing body comprises a gel containing body.

* * * * *